US009618279B2

(12) United States Patent
Lutz et al.

(10) Patent No.: US 9,618,279 B2
(45) Date of Patent: Apr. 11, 2017

(54) EVAPORATOR TUBE HAVING AN OPTIMISED EXTERNAL STRUCTURE

(71) Applicants: Ronald Lutz, Blaubeuren (DE); Andreas Beutler, Weissenhorn (DE); Andreas Schwitalla, Voehringen (DE); Markus Revermann, Wietmarschen (DE); Christian Rettich, Dellmensingen (DE)

(72) Inventors: Ronald Lutz, Blaubeuren (DE); Andreas Beutler, Weissenhorn (DE); Andreas Schwitalla, Voehringen (DE); Markus Revermann, Wietmarschen (DE); Christian Rettich, Dellmensingen (DE)

(73) Assignee: WIELAND-WERKE AG, Ulm (DE)

( * ) Notice: Subject to any disclaimer, the term of this patent is extended or adjusted under 35 U.S.C. 154(b) by 254 days.

(21) Appl. No.: 14/365,850

(22) PCT Filed: Nov. 21, 2012

(86) PCT No.: PCT/EP2012/004811
§ 371 (c)(1),
(2) Date: Jun. 16, 2014

(87) PCT Pub. No.: WO2013/091759
PCT Pub. Date: Jun. 27, 2013

(65) Prior Publication Data

US 2014/0352939 A1 Dec. 4, 2014

(30) Foreign Application Priority Data

Dec. 21, 2011 (DE) ..... 10 2011 121 733

(51) Int. Cl.
*F28F 1/10* (2006.01)
*F28F 13/18* (2006.01)
*F28D 21/00* (2006.01)

(52) U.S. Cl.
CPC ..... *F28F 1/10* (2013.01); *F28F 13/187* (2013.01); *F28D 2021/0064* (2013.01)

(58) Field of Classification Search
CPC ..... F28F 1/12; F28F 1/16; F28F 1/36; F28F 1/42; F28F 13/187; F28D 2021/0064
(Continued)

(56) References Cited

U.S. PATENT DOCUMENTS 3,696,861 A 10/1972 Webb
4,060,125 A * 11/1977 Fujie ..... F28F 13/187 165/133
(Continued)

FOREIGN PATENT DOCUMENTS

CN 1731066 A 2/2006
DE 27 58 526 A1 7/1979
(Continued)

OTHER PUBLICATIONS

Form PCT/ISA/210 International Search Report issued in International Application No. PCT/EP2012/004811 with English translation, date of mailing May 14, 2013 (4 pages).
(Continued)

*Primary Examiner* — Tho V Duong
(74) *Attorney, Agent, or Firm* — Flynn, Thiel, Boutell & Tanis, P.C.

(57) ABSTRACT

A metal heat exchanger tube for the evaporation of liquids on the outside of the tube, having a tube axis, a tube wall, and integrally formed ribs that run circumferentially on the outside of the tube. The ribs have a rib foot, rib flanks, and a rib tip, wherein the rib foot projects substantially radially
(Continued)

from the tube wall. A respective groove is located between every two ribs that are adjacent to one another in the axial direction. At least first, second, and third lateral material projections, which are formed from the material of the ribs, are arranged on a first, second, and third level on the rib flanks in such a way that the grooves are largely covered by all of the material projections. The first, second, and third lateral material projections are formed on levels that are in each case differently spaced apart from the tube wall in the radial direction.

8 Claims, 11 Drawing Sheets

(58) Field of Classification Search
USPC ..... 165/184
See application file for complete search history.

(56) References Cited

U.S. PATENT DOCUMENTS

| | | | | |
|---|---|---|---|---|
| 4,179,911 | A | 12/1979 | Saier et al. | |
| 4,216,826 | A | 8/1980 | Fujikake | |
| 4,438,807 | A * | 3/1984 | Mathur | F28F 1/42 165/133 |
| 4,577,381 | A | 3/1986 | Sato et al. | |
| 4,660,630 | A | 4/1987 | Cunningham et al. | |
| 5,054,548 | A | 10/1991 | Zohler | |
| 5,669,441 | A | 9/1997 | Spencer | |
| 5,697,430 | A | 12/1997 | Thors et al. | |
| 6,067,832 | A | 5/2000 | Brand et al. | |
| 6,173,762 | B1 * | 1/2001 | Ishida | F28F 1/42 165/133 |
| 6,786,072 | B2 | 9/2004 | Beutler et al. | |
| 6,913,073 | B2 | 7/2005 | Beutler et al. | |
| 7,178,361 | B2 | 2/2007 | Thors et al. | |
| 7,254,964 | B2 | 8/2007 | Thors et al. | |
| 7,789,127 | B2 | 9/2010 | Lu et al. | |
| 2002/0000312 | A1 * | 1/2002 | Brand | F28F 13/187 165/179 |
| 2002/0092644 | A1 | 7/2002 | Beutler et al. | |
| 2003/0024121 | A1 | 2/2003 | Beutler et al. | |
| 2007/0034361 | A1 | 2/2007 | Lu et al. | |
| 2007/0131396 | A1 * | 6/2007 | Yu | F25B 39/04 165/133 |
| 2008/0196876 | A1 | 8/2008 | Cao et al. | |
| 2009/0071624 | A1 * | 3/2009 | Zhang | F21V 29/004 165/80.3 |

FOREIGN PATENT DOCUMENTS

| | | | |
|---|---|---|---|
| DE | 197 57 526 | C1 | 4/1999 |
| EP | 0 713 072 | A2 | 5/1996 |
| EP | 1 223 400 | A2 | 7/2002 |
| GB | 1 292 767 | | 10/1972 |
| JP | 60-64194 | A | 4/1985 |
| JP | 2011-127784 | A | 6/2011 |

OTHER PUBLICATIONS

Office Action of German Patent Office issued in Application No. 10 2011 121 733.2 with English translation dated Oct. 12, 2012 (7 pages).

English translation of Reason for Rejection of Japan Patent Office issued in Application No. 2014-546341 dated Mar. 6, 2015 (4 pages).

Official Letter and Search Report of Taiwan Patent Office issued in Application No. 101140779 with English translation dated Jul. 7, 2016 (11 pages).

* cited by examiner

EVAPORATOR TUBE HAVING AN OPTIMISED EXTERNAL STRUCTURE

The invention relates to a metal heat exchanger tube for the evaporation of liquids from pure substances or mixtures on the outside of the tube.

Heat transfer occurs in many technical processes, e.g. in the refrigeration and air conditioning industries or in the chemicals and energy industries. In the heat exchangers, heat is transferred from one medium to another medium. The media are generally separated by a wall. This wall serves as a heat transfer surface and serves to separate the media.

In order to allow heat transfer between the two media, the temperature of the medium that is releasing heat must be higher than the temperature of the medium which is absorbing heat. This temperature difference is referred to as the driving temperature difference. The higher the driving temperature difference, the more heat can be transferred per unit of heat transfer surface. On the other hand, the aim is often to keep the driving temperature difference small since this has advantages for the efficiency of the process.

It is known that heat transfer can be improved by structuring the heat transfer surface. It is thereby possible to ensure that more heat can be transferred per unit of heat transfer surface than in the case of a smooth surface. It is furthermore possible to reduce the driving temperature difference and thus make the process more efficient.

A frequently used embodiment of heat exchanger is a shell and tube heat exchanger. In this apparatus, use is often made of tubes which are structured both on the inside and outside thereof. Structured heat exchanger tubes for shell and tube heat exchangers generally have at least one structured region and smooth end pieces and possibly smooth intermediate pieces. The smooth end or intermediate pieces delimit the structured regions. To enable the tube to be installed in the shell and tube heat exchanger without problems, the outside diameter of the structured regions must not be larger than the outside diameter of the smooth end and intermediate pieces.

To increase heat transfer during evaporation, the process of nucleate boiling is intensified. It is known that the formation of bubbles begins at nucleation sites. These nucleation sites are usually small gas or vapor inclusions. Such nucleation sites can be generated simply by roughening the surface. When the growing bubble has reached a certain size, it detaches itself from the surface. When the nucleation site is flooded with inflowing replacement fluid as the bubble detaches itself, the gas or vapor inclusion may be displaced by liquid. In this case, the nucleation site is deactivated. This can be avoided through suitable design of the nucleation sites. For this purpose, it is necessary that the opening of the nucleation site should be smaller than the cavity lying below the opening.

It is prior art to produce structures configured in this way on the basis of integrally rolled ribbed tubes. The term "integrally rolled ribbed tubes" is taken to mean ribbed tubes on which the ribs have been formed from the wall material of a smooth tube. The ribs are thus connected monolithically to the tube wall and can therefore transfer heat in an optimum manner. Such ribbed tubes have a round cross section over the entire length thereof, and the outer contour of the ribbed tube is coaxial with the tube axis. Various methods by means of which the channels situated between adjacent ribs can be closed in such a way that connections remain between the channel and the surroundings in the form of pores or slits are known. Since the opening of the pores or slits is smaller than the width of the channels, the channels form suitably shaped cavities for promoting the formation and stabilization of bubble nucleation sites. In particular, such substantially closed channels are produced by bending or folding over the ribs (U.S. Pat. No. 3,696,861, U.S. Pat. No. 5,054,548, U.S. Pat. No. 7,178,361, U.S. Pat. No. 7,254,964), by splitting and upsetting the ribs (DE 27 58 526 A1, U.S. Pat. No. 4,577,381) and by notching and upsetting the ribs (U.S. Pat. No. 4,660,630, EP 0 713 072 A2, U.S. Pat. No. 4,216,826, U.S. Pat. No. 5,697,430, U.S. Pat. No. 7,789,127). In the case of structures which are produced by bending over or splitting the ribs, it is disadvantageous that even small changes in the rib geometry caused by manufacturing tolerances or tool wear lead to a performance-reducing change in the pore structure.

The highest-performance commercially available ribbed tubes for flooded evaporators have a rib structure on the outside of the tube with a rib density of 55 to 60 ribs per inch (U.S. Pat. No. 5,669,441, U.S. Pat. No. 5,697,430, DE 197 57 526 Cl). This corresponds to a rib pitch of about 0.45 to 0.40 mm. In principle, it is possible to improve the performance of such tubes through an even higher rib density or smaller rib pitch since the density of the bubble nucleation sites is thereby increased. A smaller rib pitch necessarily likewise requires tools that are of higher precision. However, tools of higher precision are subject to a higher risk of breaking and more rapid wear. Currently available tools permit reliable manufacture of ribbed tubes with rib densities of no more than 60 ribs per inch. Moreover, with decreasing rib pitch the tube production rate is lower and production costs are consequently higher. It is known that the performance of evaporator tubes can be increased by introducing further structures in the region of the channel bottom. Undercut secondary grooves are proposed for this purpose in EP 1 223 400 B1. The additional lateral elements on the flanks of the ribs, as proposed in U.S. Pat. No. 7,789,127, act in a similar way. In US 2008/0196876 A1, a description is given of a ribbed tube which is supposed to be used both for the evaporation and for the condensation of refrigerants. To intensify evaporation, the channels between the ribs are substantially closed, apart from pores, by lateral material projections arranged on the rib flanks at only slightly different levels. Since these material projections act like a virtually closed barrier for the exchange of liquid and vapor, maintaining the correct pore size represents a difficulty. Further lateral material projections on the rib tip do not contribute to covering the channels but serve to improve the heat transfer in the case of condensation.

It is an object to specify a heat exchanger tube with an improved performance over the prior art for the evaporation of liquids on the outside of the tube with the same heat transfer and pressure drop across the tube and the same production costs.

The invention is represented by the features discussed below. Other advantageous embodiments and developments of the invention are also shown below.

The invention includes a metal heat exchanger tube for the evaporation of liquids on the outside of the tube, comprising a tube axis, a tube wall, and integrally formed ribs that run circumferentially on the outside of the tube. The ribs have a rib foot, rib flanks, and a rib tip, wherein the rib foot projects substantially radially from the tube wall. There is a respective groove between every two ribs that are adjacent to one another in the axial direction. Lateral material projections formed from material of the ribs are arranged on the rib flanks. According to the invention, at least first, second, and third lateral material projections are arranged in such a way that the grooves are largely covered by the material projections taken as a whole, wherein the first, second and third lateral material projections are formed on levels that are in each case differently spaced apart from the tube wall in the radial direction.

The present invention relates to structured tubes for use in heat exchangers in which the heat-absorbing medium evaporates. Shell and tube heat exchangers, in which liquids comprising pure substances or mixtures evaporate on the outside of the tube and, in the process, cool brine or water on the inside of the tube, are often used as evaporators.

The invention starts from the consideration that increases in performance can be achieved with evaporator tubes if the grooves between the ribs are closed in a suitable manner by deforming the ribs, giving rise to an undercut structure. During nucleate boiling, there are small vapor inclusions in the grooves at the groove bottom in the region of the rib foot. These vapor inclusions are the nucleation sites for the vapor bubbles. When the growing bubble has reached a certain size, it is released from the groove between the ribs and from the tube surface. If the nucleation site is flooded with liquid as the bubble detaches itself, the nucleation site is deactivated. The structure on the tube surface must therefore be designed in such a way that, as the bubble detaches itself, a small bubble remains behind and then serves as a nucleation site for a new bubble formation cycle.

Studies have shown that it is advantageous for the process of bubble formation if the grooves are largely covered by lateral material projections, which are formed on both flanks of the grooves and are formed from material of the rib flank or the rib tip on at least three levels differently spaced apart from the tube wall in the radial direction. In this arrangement, the material projections on at least three levels each make a significant contribution to the coverage of the grooves. The substantial, virtually complete, coverage of the grooves by means of the lateral material projections according to the invention prevents the small vapor inclusions from escaping from the grooves during nucleate boiling. The bubble nucleation sites are thus retained more effectively in the grooves than is the case with structures known from the prior art. The penetration of liquid into the grooves is reduced to such an extent that even small bubble nucleation sites are not flooded. The vapor formed is retained in the structure until the vapor bubble has reached a sufficient size to detach itself from the bubble nucleation site.

That proportion of the groove bottom which is visible when viewed in the radial direction, relative to the outer tube surface, can be chosen as a measure of the degree of coverage of the grooves. Here, the outer tube surface is taken to be the smooth tube surface (=enveloping surface) formed by the outer tube diameter. Studies show that the better the evaporation performance, the smaller the visible proportion of the groove bottom. A large degree of coverage of the grooves in the sense according to this invention is present when that proportion of the groove bottom which is visible when viewed in the radial direction, relative to the outer tube surface, is no more than 10%.

The size of the vapor inclusions which act as bubble nucleation sites is dependent on the properties of the substance to be evaporated, the pressure and the local temperature conditions, especially the excess temperature of the tube wall in relation to the evaporation temperature. To allow the vapor inclusions to assume a sufficient size, it is advantageous to choose the spacing of the lateral material projections formed closest to the tube wall, relative to the tube wall, to be greater than half the groove width. The width W of the groove is measured between the rib flanks above the rib foot. Consequently, these material projections are arranged in the region of the rib flank above the rib foot.

The lateral material projections can be of continuous or discontinuous design in the circumferential direction of the tube. The cross sections of lateral material projections of continuous design changed only insignificantly along the circumferential direction of the tube. The cross sections of lateral material projections of discontinuous design change significantly along the circumferential direction of the tube; they can even be interrupted at some points. It is furthermore possible to make some of the lateral material projections continuous and others of the lateral material projections discontinuous.

In a preferred embodiment of the invention, the grooves can be covered to such an extent that the groove bottom is visible over at most 4% of the tube surface when viewed radially. This can be achieved by suitable dimensioning of the ribs and of the lateral material projections. The material projections can be formed on both flanks of the groove. In particular, the width W of the grooves and the lateral extent of the material projections can be matched to one another.

As a preferred option, the grooves can be covered to such an extent that the groove bottom is visible over at most 2% of the tube surface when viewed radially. Once again, material projections can be formed on both flanks of the groove.

A very advantageous embodiment of the invention can be obtained if the grooves are covered to such an extent, by material projections formed on both flanks of the groove for example, that the groove bottom is not visible when viewed radially.

In a preferred embodiment of the invention, the lateral material projections can be of discontinuous design in the circumferential direction of the tube on at least one level. Discrete openings or pores are thereby formed in the system of the lateral material projections. Liquid and vapor transfer then takes place through these openings.

In order to be able to influence the process of bubble formation in a specific way, it is advantageous not to arrange the different-level lateral material projections of discontinuous design in the circumferential direction of the tube in a random manner but to position them in a predetermined manner and in a mutually correlated way in the circumferential direction of the tube. An optimum structure can thereby be produced on the entire tube surface.

In a particularly advantageous embodiment of the invention, the lateral material projections can be of a discontinuous design in the circumferential direction of the tube on at least two levels, and the lateral material projections on these levels can be arranged at least partially offset relative to one another in the circumferential direction of the tube. The partially offset arrangement of the material projections gives rise to a system of interrupted planes with passages. The cross-sectional areas of the through openings are larger than is apparent when viewed radially. The vapor formed can thus leave the groove without major resistance. At the same time, liquid cannot penetrate into the groove bottom along a direct route from the surroundings since the groove bottom is largely covered by the material projections according to the invention. This prevents the flooding of bubble nucleation sites in an effective manner and thus stabilizes the process of nucleate boiling. Thus, a structure is formed which brings the supply of liquid and the removal of vapor into equilibrium in an advantageous manner.

In a particularly advantageous embodiment, the grooves can be covered to such an extent that the groove bottom is visible only through openings with an area of at most 0.007

$mm^2$ when viewed radially. Owing to statistical fluctuations in the production process, individual openings may be larger than 0.007 $mm^2$. It is understandable for a person skilled in the art that the mean area of the openings should not be larger than 0.007 $mm^2$, and the chosen scatter in the opening size should preferably be small enough to ensure that the performance of the structure is not negatively influenced. In the case of regularly repeated lateral material projections of a discontinuous design, the pitch and extent of the material projections in the circumferential direction can be adapted in order to cover the groove bottom in a corresponding manner. The smaller the part of the groove bottom which is visible when viewed radially, the better is the evaporation performance.

Another advantageous embodiment can be available if the lateral extent of the material projections is so great on at least one level that they overlap in the axial direction with the lateral material projections which are formed on at least one other level on the opposite rib flank, and that the radial distance of these material projections from the tube wall is chosen in such a way that narrow passages remain between the material projections in the region of overlap. As a result, the bubble nucleation sites are retained in the groove in a particularly effective manner. The groove bottom is covered in multiple fashion at many points. The narrow passages in the region of overlap ensure the exchange of liquid and vapor.

In a particularly advantageous embodiment, the ribs of an integrally rolled ribbed tube can be provided with notches which extend in the direction of the rib foot from the rib tip. The depth of the notching is less than the height of the ribs. On the level of the notches, material of the rib which has been displaced radially by the notching forms first lateral material projections, which, on a first level, partially cover the groove between two ribs that are adjacent in the axial direction. There are second lateral material projections between the rib tip and the level of the notches, said projections partially covering the groove on a second level. The regions of the rib tip which are situated between two notches that are adjacent in the circumferential direction of the tube are widened in the axial direction, with the result that the widened regions of the rib tip form third lateral material projections, which, on a third level, partially cover the groove. The grooves are largely covered by the material projections taken as a whole. The first material projections formed by the notching of the rib and the third material projections on the rib tip are of a discontinuous design in the circumferential direction of the tube. These two material projections are arranged offset from one another. The second lateral material projections can be formed by substantially radial displacement of material of the rib tip. They can be of a discontinuous or virtually continuous design. In this embodiment, the first, second and third lateral material projections are arranged in a predetermined correlation with one another in the circumferential direction. The lateral material projections are of suitable design if the groove bottom is visible over less than 4% of the tube surface when viewed radially from the outside. In the ideal case, the groove bottom is no longer visible from the outside.

Illustrative embodiments of the invention are explained in greater detail by means of the schematic drawings.

In the drawings:

FIG. 1 schematically shows a sectional view of a ribbed tube according to the invention;

Figure 1:
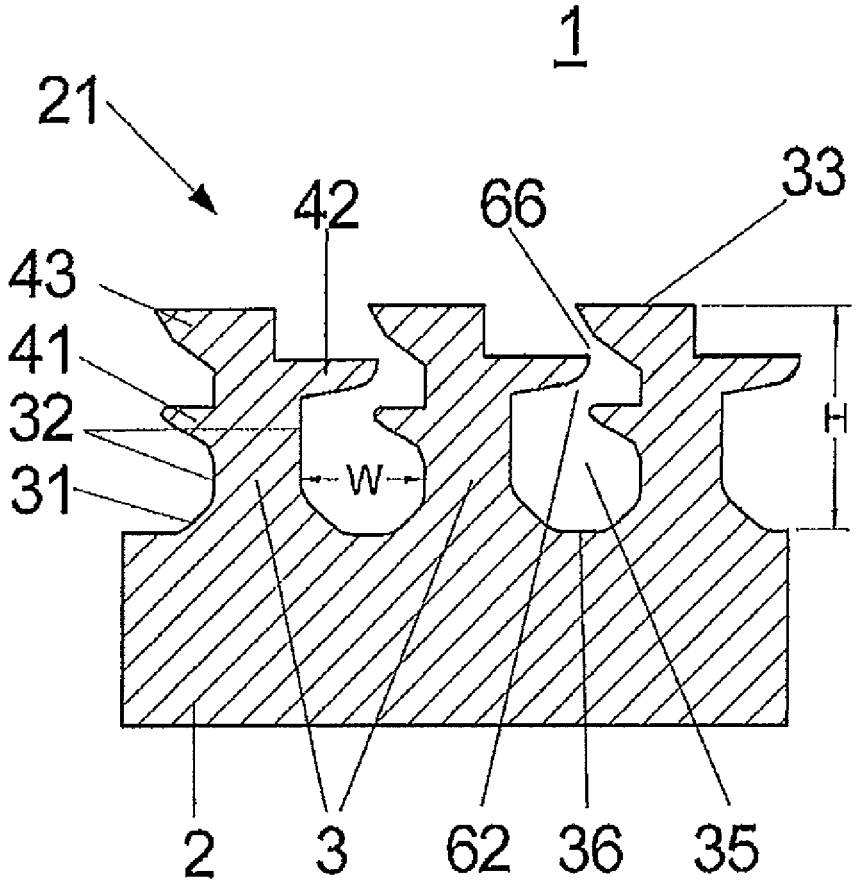

Parts that correspond to one another are provided with the same reference signs in all the figures.

The integrally rolled ribbed tube 1 shown in FIGS. 1 to 11 has a tube wall 2 and one or more ribs 3 that run circumferentially in the form of a helical line on the outer side 21 of the tube. In order to keep down production costs, the ribs 3 usually run around like a multi-start thread. The case where just one rib 3 runs around like a single-start thread makes no difference in respect of the invention. Therefore, this case is included in the invention, even if the term "ribs" is always used in the plural. The ribs 3 project substantially radially from the tube wall 2. The ribs 3 have a rib foot 31, rib flanks 32 and a rib tip 33. In the region of the rib foot 31, the ribs 3 have a curved contour, which can be described by means of a radius of curvature. The rib foot 31 extends in the radial direction from the tube wall 2 to the point at which the curved contour of the rib 3 merges into the rib flank 32. The rib flank 32 extends from the rib foot 31 to the rib tip 33. The rib height H is measured from the tube wall 2 to the rib tip 33. All the ribs have the same height H. The rib height H is typically 0.5 to 0.7 mm and is thus between 2% and 5% of the tube diameter, depending on the tube diameter. There is a respective groove 35 between every two ribs 3 that are adjacent in the axial direction. The grooves 35 are at least twice as wide as the radius of curvature at the rib foot 31. The width W of the groove 35 is measured between the rib flanks 32 above the rib foot 31.

FIG. 1 shows a sectional view of a ribbed tube 1 according to the invention longitudinally with respect to the tube axis. On the left-hand side of each rib 3 there are first lateral material projections 41 above the rib foot 31. On the right-hand side of each rib 3 there are second lateral material projections 42, which are spaced apart further from the tube wall 2 than the first material projections 41. The second material projections 42 are arranged below the rib tip 33, on the rib flank 32. There are furthermore third lateral material projections 43 on the left-hand side of each rib 3, at the level of the rib tip 33. The third lateral material projections 43 are spaced apart further from the tube wall 2 than the second material projections 42. The first material projections 41 and the second material projections 42 extend laterally over the groove 35 in such a way that an overlap is formed in the axial direction between the first 41 and the second 42 material projections of respectively adjacent ribs 3. Since the first 41 and second 42 material projections are spaced apart differently from the tube wall 2, a narrow passage 62 remains between the first 41 and second 42 material projections. The second material projections 42 and the third material projections 43 extend laterally over the groove 35 in such a way that an overlap is formed in the axial direction between the second 42 and the third 43 material projections of respectively adjacent ribs 3. Since the second 42 and third 43 material projections are spaced apart differently from the tube wall 2, a narrow passage 66 remains between the two material projections 42 and 43. The material projections 41, 42 and 43 illustrated in FIG. 1 can be of continuous or discontinuous design in the circumferential direction of the tube. If they are of continuous design, the sectional view illustrated in FIG. 1 can be found in at most insignificantly modified form in each section plane in the circumferential direction of the tube. In this case, the grooves 35 between two ribs 3 that are adjacent in the axial direction are completely covered by the lateral material projections 41, 42 and 43 taken as a whole, with the result that the groove bottom 36 is not visible from the outside.

Figure 2:
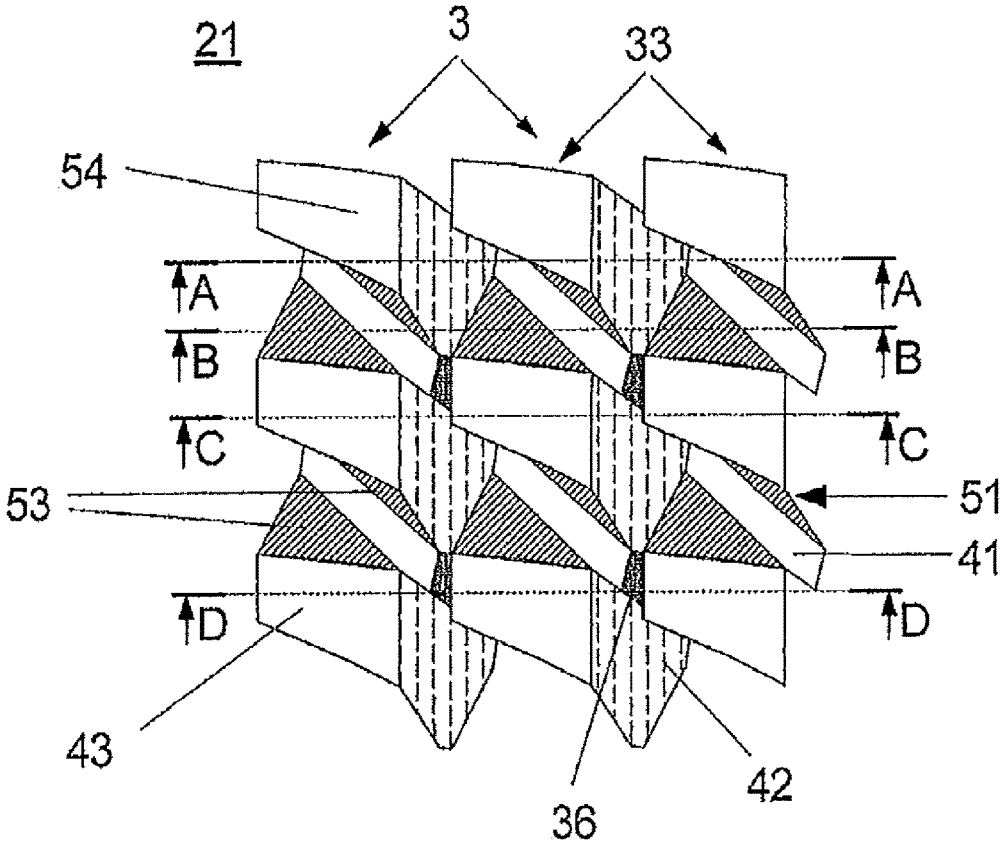
FIG. 2 shows the outer view of a ribbed tube according to the invention with a partially visible groove bottom.

FIG. 2 shows the outside view of an advantageous embodiment of a ribbed tube 1 according to the invention. In FIG. 2, the ribs 3 run in a vertical direction, while the tube axis runs in a horizontal direction. The ribs 3 are provided with notches 51, which extended from the rib tip 33 in the direction of the rib foot. The notches 51 preferably enclose an angle of about 45° with the ribs 3. On the level of the notches 51, material of the rib 3 forms first lateral material projections 41, which partially cover the groove 35 between two ribs 3 that are adjacent in the axial direction. Between the rib tip 33 and the level of the notches 51 there are second lateral material projections 42, which partially cover the groove 35. The regions 54 of the rib tip 33 which are situated between two notches 51 that are adjacent in the circumferential direction of the tube are furthermore widened on one side in the axial direction, with the result that the widened regions 54 of the rib tip 33 form third lateral material projections 43, which partially cover the groove. The first lateral material projections 41, which have been formed by notching the rib 3, and the third lateral material projections 43 on the rib tip 33 are of discontinuous design in the circumferential direction of the tube. These material projections 41 and 43 are arranged offset relative to one another. The second lateral material projections 42 can be formed by substantially radial displacement of material of the rib tip 33. If, as illustrated in FIG. 2, two second material projections 42 that are adjacent in the circumferential direction of the tube do not adjoin one another, they are of discontinuous design. In this embodiment, the first 41, second 42 and third 43 lateral material projections are arranged in a predetermined correlation relative to one another in the circumferential direction. Material projections 53 are furthermore formed on the flanks of the notch 51 by the notching of the rib. These material projections 53 connect the first lateral material projections 41 to the second 42 and third 43 lateral material projections. By means of the totality of all the lateral material projections 41, 42 and 43 and of the material projections 53 on the flanks of the notches 51, the grooves between two ribs 3 that are adjacent in the axial direction are largely covered. In the embodiment illustrated in FIG. 2, the groove bottom 36 is visible only at a few points from the outside when viewed radially.

Figure 3:
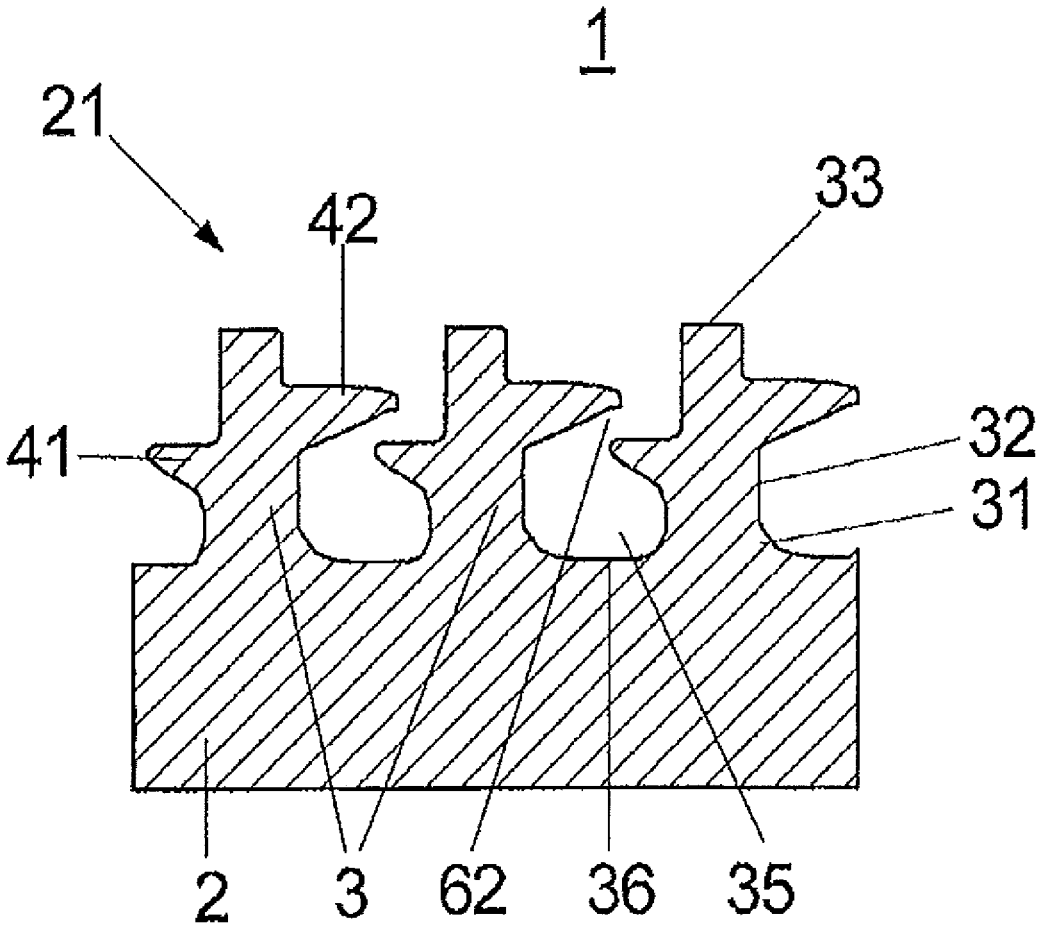
FIG. 3 shows a sectional view of the ribbed tube illustrated in FIG. 2, in section plane A-A.

FIG. 3 shows a sectional view of the ribbed tube 1 illustrated in FIG. 2, in section plane A-A. On the left-hand side of each rib 3, above the rib foot 31, there are first lateral material projections 41, which have been formed by notching the rib 3. On the right-hand side of each rib 3 there are second lateral material projections 42, which are spaced apart further from the tube wall 2 than the first material projections 41. The second material projections 42 are arranged on the rib flank 32 below the rib tip 33. The first material projections 41 and the second material projections 42 extend laterally over the groove 35 in such a way that an overlap is formed in the axial direction between the first 41 and the second 42 material projections of respectively adjacent ribs 3. For this reason, the groove bottom 36 is not visible from the outside when viewed radially in section plane A-A. Since the first 41 and second 42 material projections are spaced apart differently from the tube wall 2, a narrow passage 62 remains between the two material projections 41 and 42.

Figure 4:
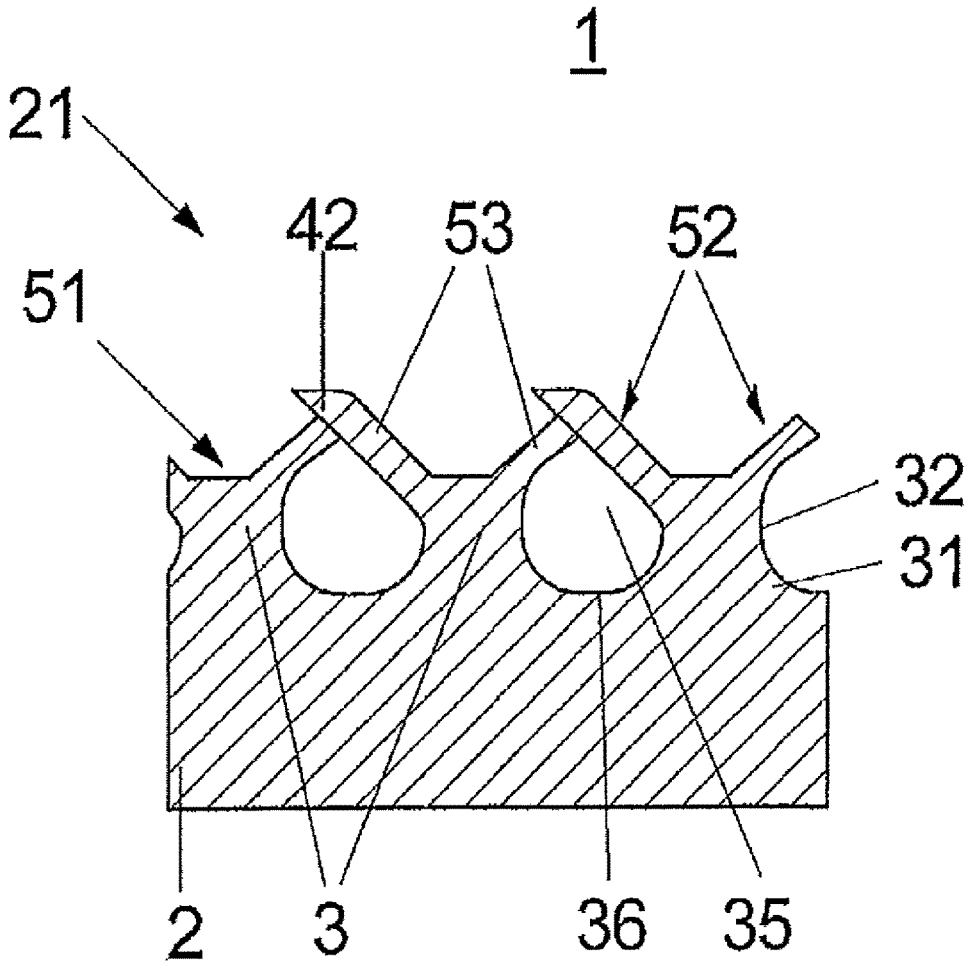
FIG. 4 shows a sectional view of the ribbed tube illustrated in FIG. 2, in section plane B-B.

FIG. 4 shows a sectional view of the ribbed tube 1 illustrated in FIG. 2, in section plane B-B. The section plane is chosen in such a way that it lies approximately centrally in a notch 51. The material on the flanks 52 of the notches 51, said material having been displaced by the notching of the ribs 3, forms material projections 53 in section plane B-B, which are arranged in a Y shape on both sides of the rib 3. In section plane B-B, the material projections 53 connect the level of the notches 51 to the level of the second lateral material projections 42. The material projections 53 on the flanks 52 of the notches 51 extend over the groove 35 in such a way that, together with the second lateral material projections 42, an overlap is formed in the axial direction between the material projections 53 of adjacent ribs 3. For this reason, the groove bottom 36 is not visible from the outside when viewed radially in section plane B-B.

Figure 5:
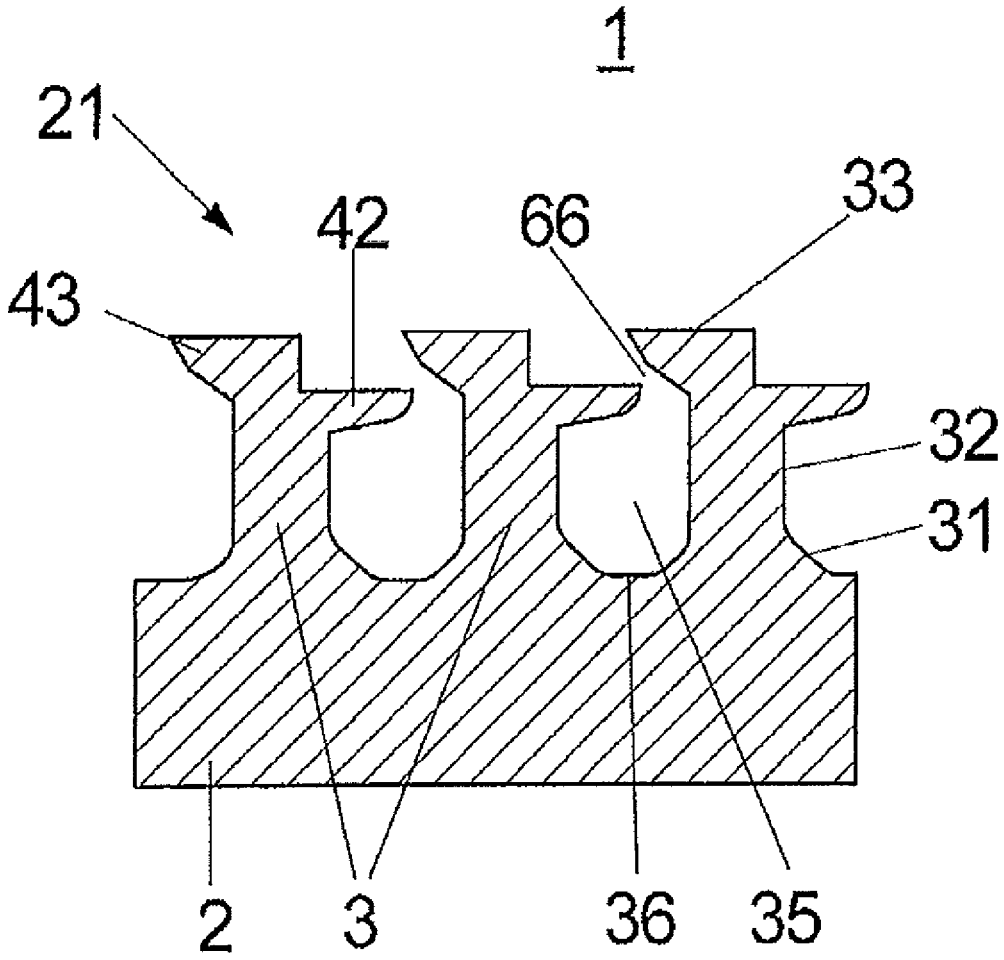
FIG. 5 shows a sectional view of the ribbed tube illustrated in FIG. 2, in section plane C-C.

FIG. 5 shows a sectional view of the ribbed tube 1 illustrated in FIG. 2, in section plane C-C. On the right-hand side of each rib 3 there are the second lateral material projections 42 that could already be seen in FIG. 3. On the left-hand side of each rib 3 there are third lateral material projections 43 on the rib tip 33, these projections having been formed by widening the rib tip 33. The third lateral material projections 43 are spaced further apart from the tube wall 2 than the second material projections 42. The second material projections 42 and the third material projections 43 extend laterally over the groove 35 in such a way that an overlap is formed in the axial direction between the second 42 and the third 43 material projections of respectively adjacent ribs 3. For this reason, the groove bottom 36 is not visible from the outside when viewed radially in section plane C-C. Since the second 42 and third 43 material projections are spaced apart differently from the tube wall 2, a narrow passage 66 remains between the two material projections 42 and 43.

Figure 6:
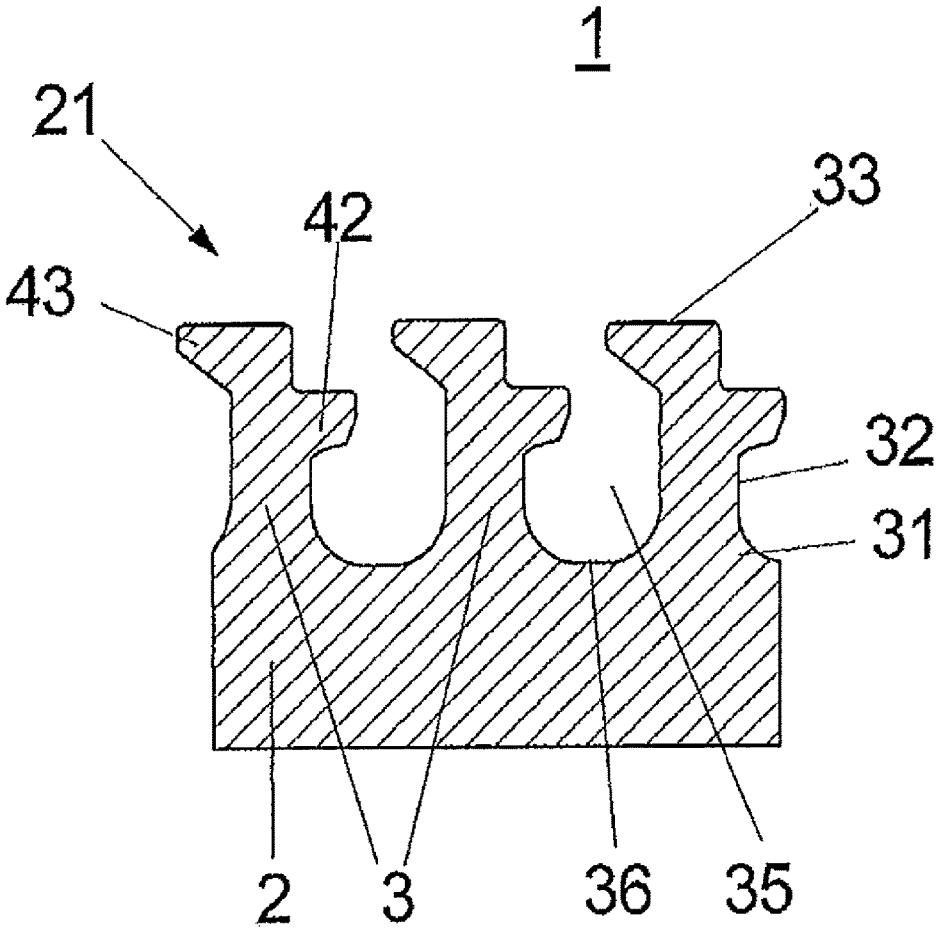
FIG. 6 shows a sectional view of the ribbed tube illustrated in FIG. 2, in section plane D-D.

FIG. 6 shows a sectional view of the ribbed tube 1 illustrated in FIG. 2, in section plane D-D. On the right-hand side of each rib 3 there are the second lateral material projections 42 that could already be seen in FIGS. 3 and 5. On the left-hand side of each rib 3, at the rib tip 33, there are the third lateral material projections 43, which could already be seen in FIG. 5 and which were formed by widening the rib tip 33. The third lateral material projections 43 are spaced further apart from the tube wall 2 than the second material projections 42. In contrast to section plane C-C, the second lateral material projections 42 in section plane D-D extend less far over the groove 35, with the result that no overlap is formed in the axial direction between the second 42 and the third 43 material projections of respectively adjacent ribs 3. For this reason, the groove bottom 36 is visible from the outside in section plane D-D when viewed radially. By means of the totality of all the lateral material projections 41, 42 and 43 and of the material projections 53 on the flanks of the notches 51, the grooves 35 between two ribs 3 that are adjacent in the axial direction are largely covered, with the result that the groove bottom 36 is visible at only a few points from the outside in the case of the embodiment of a ribbed tube according to the invention illustrated in FIGS. 2 to 6.

Figure 7:
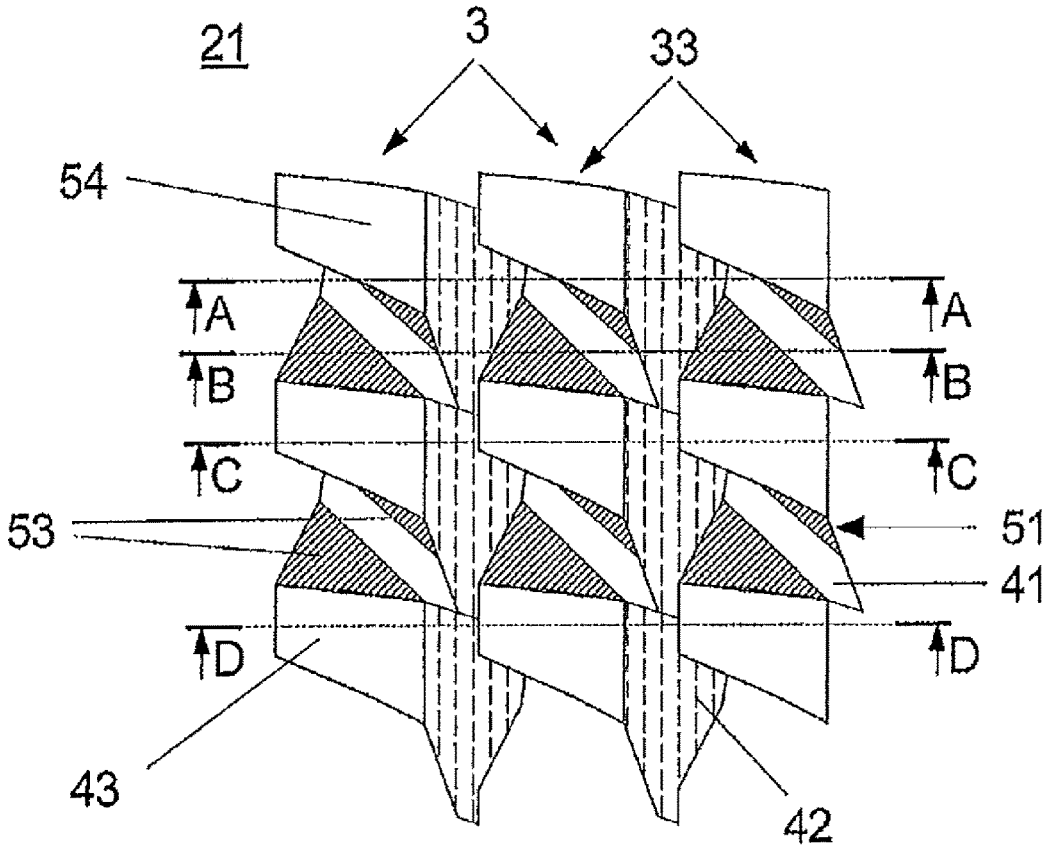
FIG. 7 shows the external view of a ribbed tube according to the invention with a groove bottom which is not visible.

FIG. 7 shows the external view of an advantageous embodiment of a ribbed tube 1 according to the invention. In FIG. 7, the ribs 3 run in a vertical direction, while the tube axis runs in a horizontal direction. The ribs 3 are provided with notches 51, which extend from the rib tip 33 in the direction of the rib foot. The notches 51 preferably enclose an angle of about 45° with the ribs. On the level of the notches 51, the material of the rib 3 forms first lateral material projections 41, which partially cover the groove between two ribs 3 that are adjacent in the axial direction. Between the rib tip 33 and the level of the notches 51 there are second lateral material projections 42, which partially cover the groove. The regions 54 of the rib tip 33 which are between two notches 51 that are adjacent in the circumferential direction of the tube are furthermore widened on one side in the axial direction, with the result that the widened regions 54 of the rib tip 33 form third lateral material projections 43, which partially cover the groove. The first lateral material projections 41, which have been formed by notching the rib 3, and the third lateral material projections 43 on the rib tip 33 are of a discontinuous design in the circumferential direction of the tube. These material projections 41 and 43 are arranged offset relative to one another. The second lateral material projections 42 can be formed by radial displacement of the rib tip 33. By appropriate simultaneous displacement of the material of the rib tip 33 in the circumferential direction, they can then be formed continuously or virtually continuously in the circumferential direction of the tube. In this embodiment, the first 41, second 42 and third 43 lateral material projections can be arranged in a predetermined correlation relative to one another in the circumferential direction. Material projections 53 are furthermore formed on the flanks of the notch 51 by notching the rib 3. These material projections 53 connect the first lateral material projections 41 to the second 42 and third 43 lateral material projections. By means of the totality of all the lateral material projections 41, 42 and 43 and of the material projections 53 on the flanks of the notches 51, the grooves between two ribs 3 that are adjacent in the axial direction are completely covered. In the embodiment illustrated in FIG. 7, the groove bottom is therefore not visible from the outside when viewed radially.

Figure 8:
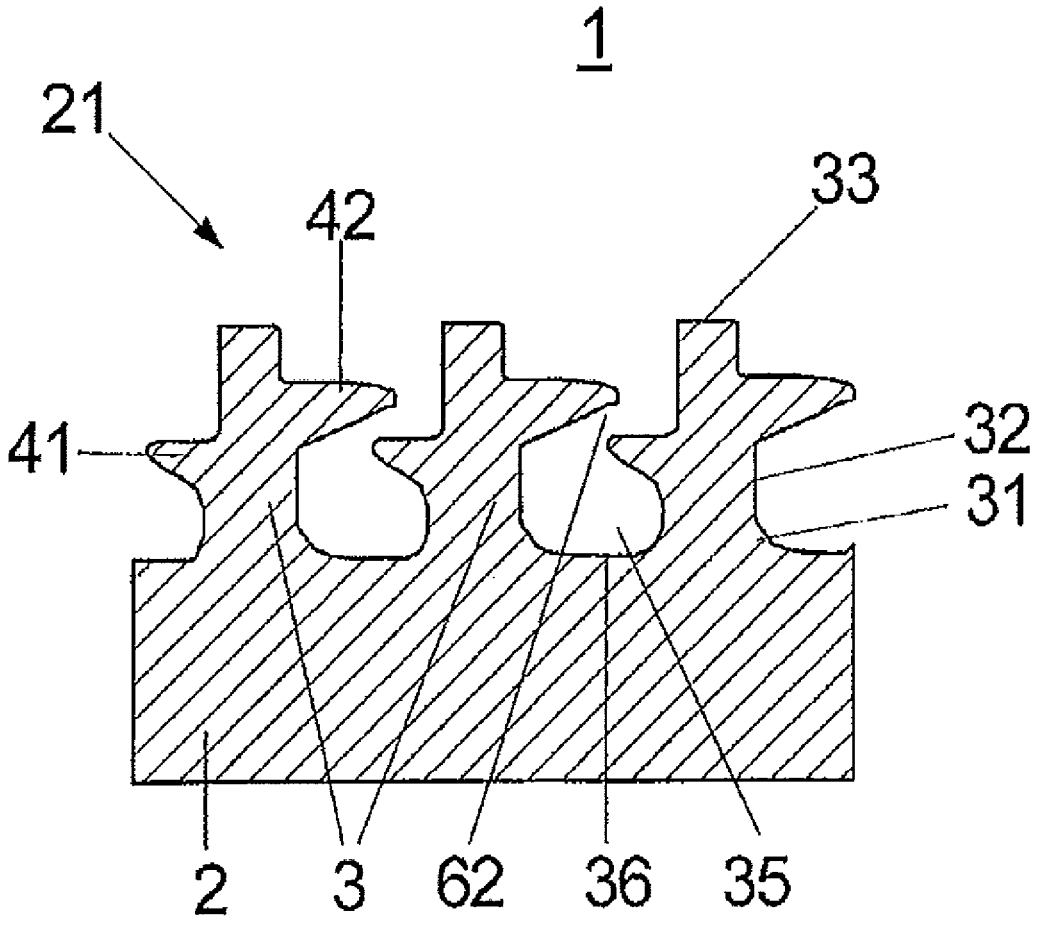
FIG. 8 shows a sectional view of the ribbed tube illustrated in FIG. 7, in section plane A-A.

FIG. 8 shows a sectional view of the ribbed tube 1 illustrated in FIG. 7, in section plane A-A. On the left-hand side of each rib 3, above the rib foot 31, there are first lateral material projections 41, which have been formed by notching the rib 3. On the right-hand side of each rib 3 there are second lateral material projections 42, which are spaced apart further from the tube wall 2 than the first material projections 41. The second material projections 42 are arranged on the rib flank 32 below the rib tip 33. The first material projections 41 and the second material projections 42 extend laterally over the groove 35 in such a way that an overlap is formed in the axial direction between the first 41 and the second 42 material projections of respectively adjacent ribs 3. For this reason, the groove bottom 36 is not visible from the outside when viewed radially in section plane A-A. Since the first 41 and second 42 material projections are spaced apart differently from the tube wall 2, a narrow passage 62 remains between the two material projections 41 and 42.

Figure 9:
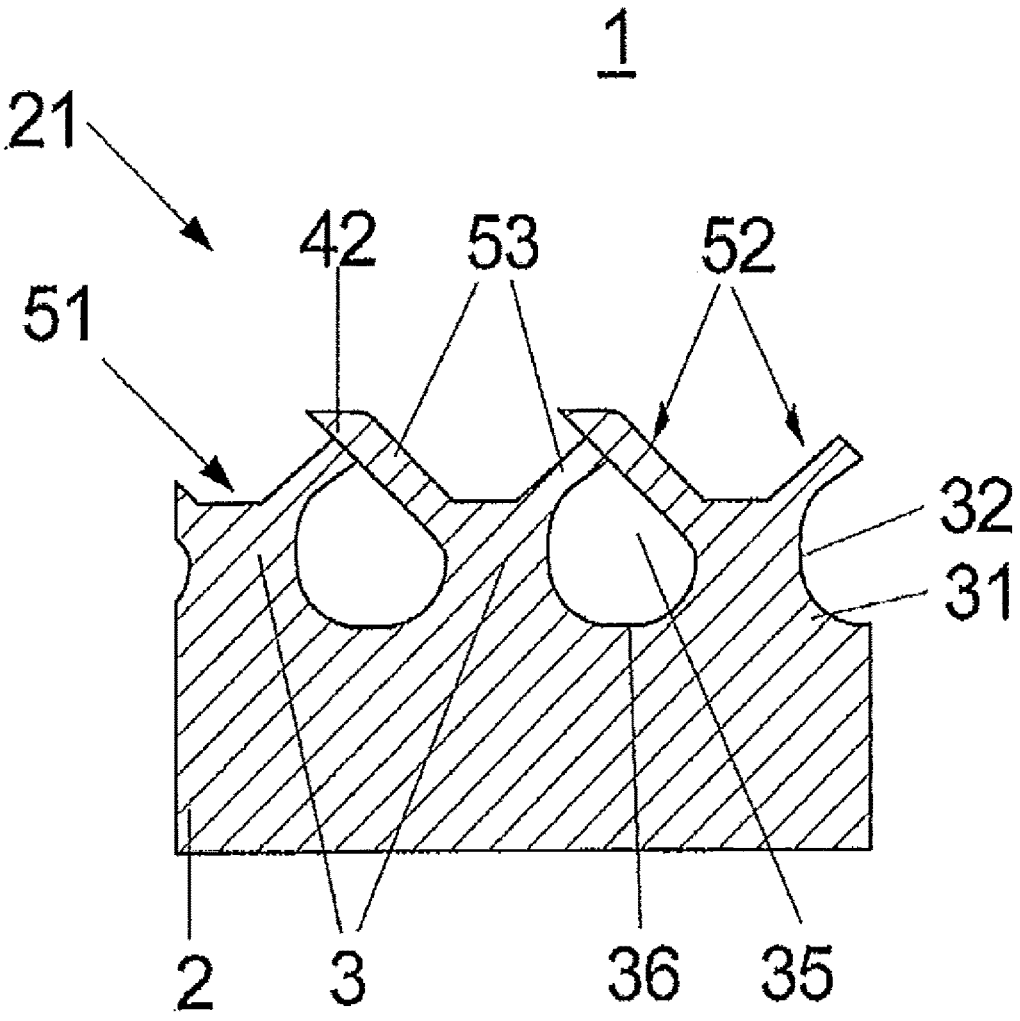
FIG. 9 shows a sectional view of the ribbed tube illustrated in FIG. 7, in section plane B-B.

FIG. 9 shows a sectional view of the ribbed tube 1 illustrated in FIG. 7, in section plane B-B. The section plane is chosen in such a way that it lies approximately centrally in a notch 51. The material on the flanks 52 of the notches 51, said material having been displaced by the notching of the ribs 3, forms material projections 53 in section plane B-B, which are arranged in a Y shape on both sides of the rib 3. In section plane B-B, the material projections 53 connect the level of the notches 51 to the level of the second lateral material projections 42. The material projections 53 on the flanks 52 of the notches 51 extend over the groove 35 in such a way that, together with the second lateral material projections 42, an overlap is formed in the axial direction between the material projections 53 of adjacent ribs 3. For this reason, the groove bottom 36 is not visible from the outside when viewed radially in section plane B-B.

Figure 10:
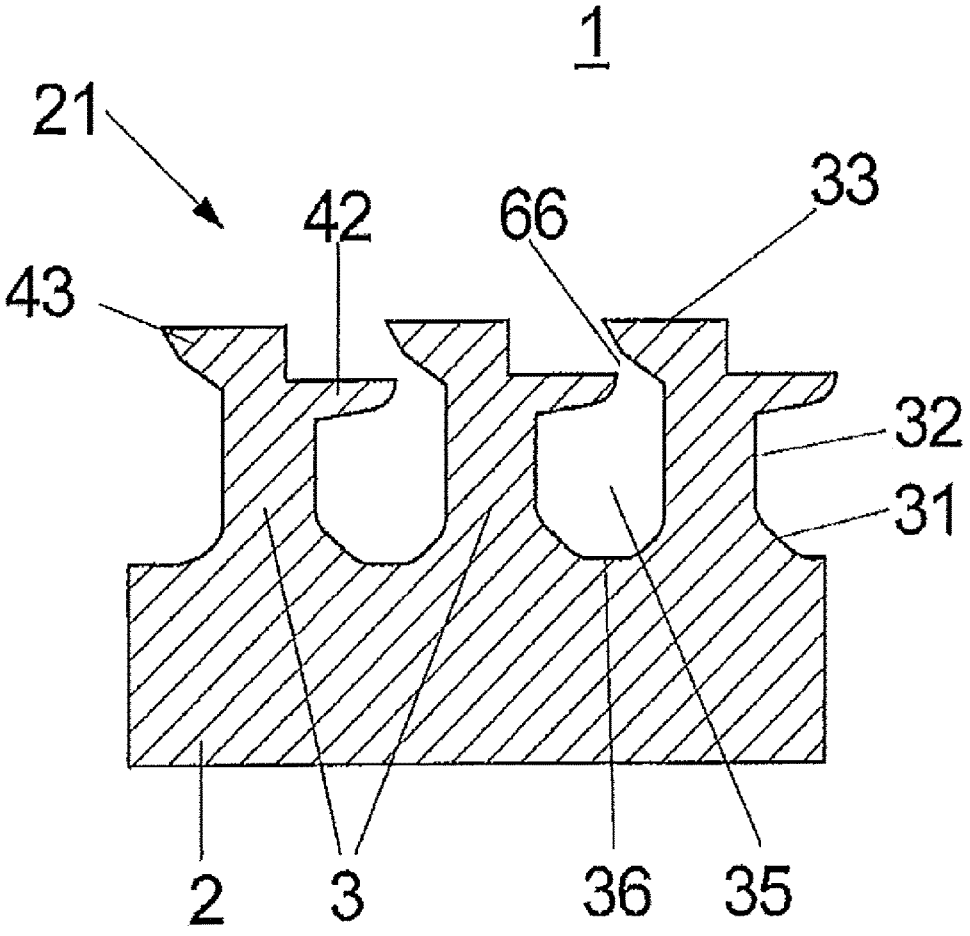
FIG. 10 shows a sectional view of the ribbed tube illustrated in FIG. 7, in section plane C-C.

FIG. 10 shows a sectional view of the ribbed tube 1 illustrated in FIG. 7, in section plane C-C. On the right-hand side of each rib 3 there are the second lateral material projections 42 that could already be seen in FIG. 8. On the left-hand side of each rib 3 there are third lateral material projections 43 on the rib tip 33, these projections having been formed by widening the rib tip 33. The third lateral material projections 43 are spaced further apart from the tube wall 2 than the second material projections 42. The second material projections 42 and the third material projections 43 extend laterally over the groove 35 in such a way that an overlap is formed in the axial direction between the second 42 and the third 43 material projections of respectively adjacent ribs 3. For this reason, the groove bottom 36 is not visible from the outside when viewed radially in section plane C-C. Since the second 42 and third 43 material projections are spaced apart differently from the tube wall 2, a narrow passage 66 remains between the two material projections 42 and 43.

Figure 11:
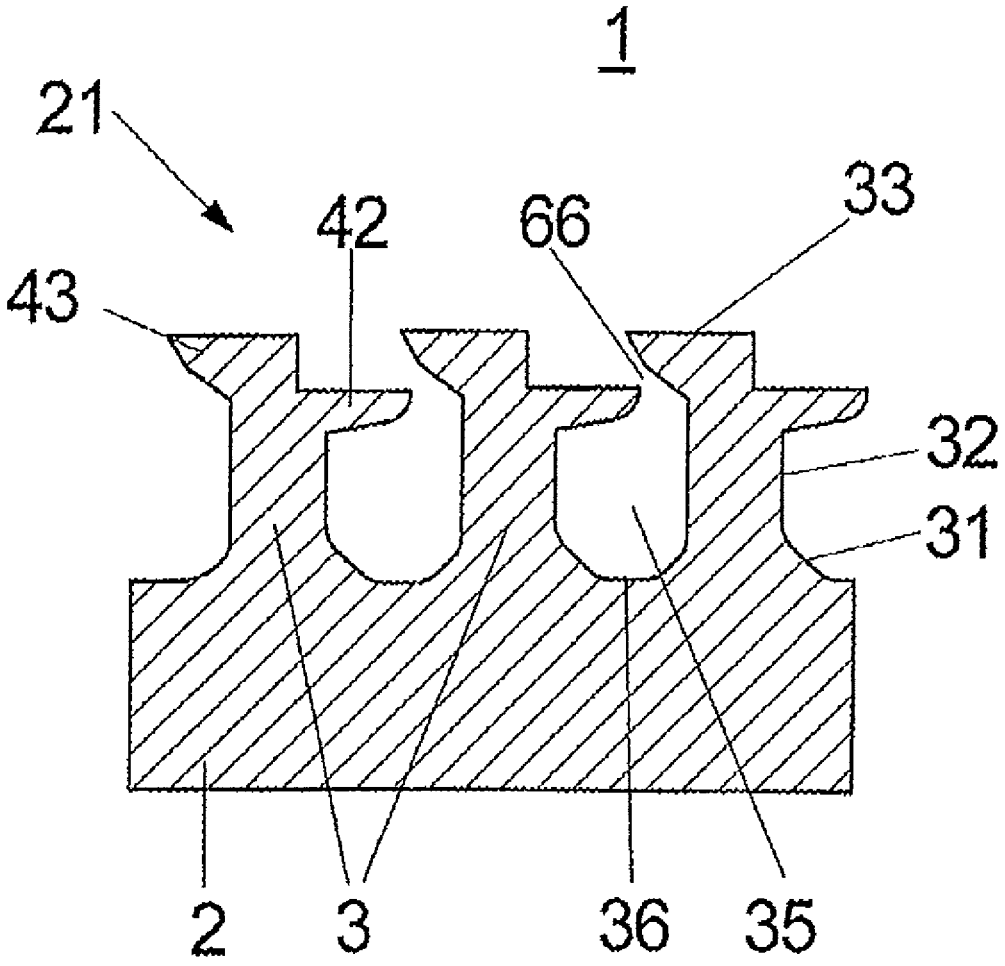
FIG. 11 shows a sectional view of the ribbed tube illustrated in FIG. 7, in section plane D-D.

FIG. 11 shows a sectional view of the ribbed tube 1 illustrated in FIG. 7, in section plane D-D. On the right-hand side of each rib 3 there are the second lateral material projections 42 that could already be seen in FIGS. 8 and 10. On the left-hand side of each rib 3, at the rib tip 33, there are the third lateral material projections 43, which could already be seen in FIG. 10 and which were formed by widening the rib tip 33. The third lateral material projections 43 are spaced further apart from the tube wall 2 than the second material projections 42. In contrast to the embodiment illustrated in FIG. 6, the lateral material projections 42 and the third material projections 43 in the embodiment illustrated in FIG. 11 extend laterally over the groove 35 in such a way that an overlap is formed in the axial direction between the second 42 and the third 43 material projections of respectively adjacent ribs 3. For this reason, the groove bottom 36 is not visible from the outside in section plane D-D when viewed radially. By means of the totality of all the lateral material projections 41, 42 and 43 and of the material projections 53 on the flanks of the notches 51, the grooves 35 between two ribs 3 that are adjacent in the axial direction are completely covered, with the result that the groove bottom 36 is not visible from the outside in the case of the embodiment of a ribbed tube according to the invention illustrated in FIGS. 7 to 11.

It has been found that it is advantageous to arrange the lateral material projections arranged closest to the tube wall at a level which is spaced apart by 40% to 50% of the rib height H from the tube wall. The lateral material projections spaced furthest apart from the tube wall are preferably on the level of the rib tip. They are therefore formed by a lateral widening of the rib tip. According to the invention there are further lateral material projections between these two levels, these being arranged on a level which is spaced apart by 50% to 80%, preferably 60% to 70%, of the rib height H from the tube wall. In this arrangement, the radial spacing between each two adjacent levels should be 15% to 30%, preferably 20% to 25%, of the rib height H.

The lateral extension of the material projections is preferably 35% to 75% of the width W of the groove. In a particularly preferred embodiment, there are at least two material projections arranged on opposite rib flanks and on different levels, their lateral extent together amounting to more than 100% of the groove width W. This ensures that said material projections overlap in the axial direction and, at the same time, that narrow passages remain in the region of overlap.

LIST OF REFERENCE SIGNS

1 heat exchanger tube
2 tube wall
21 outside of the tube
3 rib on the outside of the tube
31 rib foot
32 rib flank
33 rib tip
35 groove
36 groove bottom
41 first material projection
42 second material projection
43 third material projection
51 notch
52 flank of the notches
53 material projection on the flanks of the notches
54 region of the rib tip between the notches
62 passage
66 passage
H rib height
W groove width

The invention claimed is:

1. A metal heat exchanger tube (1) for the evaporation of liquids on the outside (21) of the tube, comprising a tube axis, a tube wall (2), and integrally formed ribs (3) that run circumferentially on the outside (21) of the tube and have a rib foot (31), rib flanks (32), and a rib tip (33), wherein the rib foot (31) projects substantially radially from the tube wall (2), the ribs (3) are provided with notches (51) which extend in a direction towards the rib foot (31) from the rib tip (33), there is a respective groove (35) between every two ribs (3) that are adjacent to one another in the axial direction, and wherein lateral material projections formed from material of the ribs (3) are arranged on the rib flanks (32), characterized in that at least first (41), second (42), and third (43) lateral material projections are arranged in such a way that the grooves (35) are largely covered by the material projections (41, 42, 43) taken as a whole, the first (41), second (42) and third (43) lateral material projections are formed on levels that are in each case differently spaced apart from the tube wall (2) in the radial direction and the depth of the notching is less than the height (H) of the ribs (3), on the level of the notches (51), material of the rib (3) forms first lateral material projections (41), which, on a first level, partially cover the groove (35) between two ribs (3) that are adjacent in the axial direction, there are second lateral material projections (42) between the rib tip (33) and the level of the notches (51), said projections partially covering, on a second level, the groove (35) between two ribs (3) that are adjacent in the axial direction, and the regions (54) of the rib tip (33) which are situated between two notches (51) that are adjacent in the circumferential direction of the tube are widened in the axial direction, with the result that the widened regions (54) of the rib tip (33) form third lateral material projections (43), which, on a third level, partially cover the groove (35) between two ribs (3) that are adjacent in the axial direction, characterized in that the grooves (35) between two ribs (3) that are adjacent in the axial direction are largely covered by the material projections (41, 42, 43) taken as a whole.

2. The heat exchanger tube (1) as claimed in claim 1, characterized in that the grooves (35) are covered to such an extent that the proportion of the groove bottom (36) that is visible is no more than 4% of the outer tube surface when viewed radially.

3. The heat exchanger tube (1) as claimed in claim 2, characterized in that the grooves (35) are covered to such an extent that the proportion of the groove bottom (36) that is visible is no more than 2% of the outer tube surface when viewed radially.

4. The heat exchanger tube (1) as claimed in claim 3, characterized in that the grooves (35) are covered to such an extent that the groove bottom (36) is not visible when viewed radially.

5. The heat exchanger tube (1) as claimed in claim 1, characterized in that the lateral material projections (41, 42, 43) are of a discontinuous design in the circumferential direction of the tube on at least one level.

6. The heat exchanger tube (1) as claimed in claim 5, characterized in that the lateral material projections (41, 42, 43) are of a discontinuous design in the circumferential direction of the tube on at least two levels, and the lateral material projections (41, 42, 43) on these levels are arranged at least partially offset relative to one another in the circumferential direction of the tube.

7. The heat exchanger tube (1) as claimed in claim 5, characterized in that the grooves (35) are covered to such an extent that the groove bottom (36) is not visible or is visible only through openings with an area of at most 0.007 $mm^2$ when viewed radially.

8. The heat exchanger tube (1) as claimed in claim 1, characterized in that the lateral extent of the material projections (41, 42, 43) is so great on at least one level that they overlap in the axial direction with the lateral material projections (41, 42, 43) which are formed on at least one other level on an opposite rib flank (32), and that the radial distance of these material projections (41, 42, 43) from the tube wall (2) is chosen in such a way that narrow passages remain between the material projections (41, 42, 43) in the region of overlap.

* * * * *